US007189104B1

(12) United States Patent
Gillespie et al.

(10) Patent No.: US 7,189,104 B1
(45) Date of Patent: Mar. 13, 2007

(54) CONNECTOR FOR FLEXIBLE PRINTED CIRCUIT

(75) Inventors: Brian J. Gillespie, Harrisburg, PA (US); Kevin E. Walker, Hershey, PA (US); Tod M. Harlan, Mechanicsburg, PA (US); Robert W. Brown, Harrisburg, PA (US); Terrance F. Little, York, PA (US); Charles E. Kreutzberger, Akson, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/283,207

(22) Filed: Nov. 18, 2005

(51) Int. Cl.
*H01R 12/24* (2006.01)

(52) U.S. Cl. ..... 439/495

(58) Field of Classification Search ..... 439/492–495
See application file for complete search history.

(56) References Cited

U.S. PATENT DOCUMENTS 6,099,346 A 8/2000 Hashiguchi et al.
6,431,897 B1 8/2002 Hashiguchi et al.
6,755,682 B2 6/2004 Kunishi et al.
6,893,288 B2 5/2005 Tsunematsu

*Primary Examiner*—Khiem Nguyen
(74) *Attorney, Agent, or Firm*—Wei Te Chung

(57) ABSTRACT

An electrical connector for connecting a sheet-like member includes terminals (2 or 2') each comprising a base portion (20 or 20'), a bearing beam (21 or 21') and a contact beam (22 or 22') substantially parallel extending from the base portion; a housing (1) including an upper wall (11), a lower wall (12) and a rear wall, and having an inner surface defining a mouth (10) for receiving the sheet-like member and an exterior surface provided with a number of grooves (13) thereon, each groove comprising an upper groove (131) defined along the upper wall for accommodating the bearing beam, a lower groove (132) defined along the lower wall for accommodating the contact beam, and a rear groove defined on the rear wall for accommodating the base portion; and an actuator (3) pivotally engaging with the bearing beams for establishing electrical connection between the sheet-like member and the contact beams.

8 Claims, 12 Drawing Sheets

CONNECTOR FOR FLEXIBLE PRINTED CIRCUIT

BACKGROUND OF THE INVENTION

1. Field of the Invention

The present invention relates to an electrical connector, and more particularly to an electrical connector for a sheet-like connection member such as a flexible printed circuit or cable (FPC), a flexible flat cable (FFC) and so forth. All of these cables and circuit hereafter will be generally referred to as "FPC" for simplification.

2. Description of Related Art

A conventional FPC connector generally includes a plurality of terminals each comprising a contact beam provided with a contact portion adapted for contacting an FPC and a pivot beam extending substantially parallel to and opposed to the contact beam, a housing adapted for holding the terminals and comprising opposite lower and upper walls defining a cavity therebetween for receiving the FPC. For fixing the terminals, the housing defines a plurality of grooves each comprising an upper section defined in the under surface of the upper wall to communicate with the cavity and a lower section defined in the upper surface of the lower wall to communicate with the cavity. Each terminal has the pivot beam thereof accommodated in the upper section of the groove and exposed to the cavity and the contact beam thereof accommodated in the lower section of the groove and exposed to the cavity, while the top surface of the pivot beam is shielded by the upper wall of the housing and the bottom surface of the contact beam is shielded by the lower wall of eth housing. Such kind of FPC connectors can be found in U.S. Pat. Nos. 6,893,288, 6,755,682 and 6,099,346.

However, as the upper wall is required to shield the top surface of the pivot beam, an extra thickness of the upper wall above the pivot beam is required, and likely, an extra thickness of the lower wall under the contact beam is required as a result of having to shield the bottom surface of the contact beam. That increases a height of the whole connector.

Otherwise, there is a conventional FPC connector in which terminals are assembled to the housing from an underside of the housing, and the top and bottom surfaces of the terminals are shieldless, yet are exposed to exterior, as disclosed in U.S. Pat. No. 6,431,897. However, such kind of FPC connectors are required to have a large width dimension in a direction along which an FPC is inserted, since the terminal has a long tail extending rearwards from a contact beam or pivot beam of the terminal. That does not meet the minimization requirement for the FPC connector as well.

Therefore, it is desired to have a new FPC connector with minimized profile.

SUMMARY OF THE INVENTION

An object of the present invention is to provide a new FPC connector with minimized profile.

In order to achieve above-mentioned object, an FPC connector for connecting an FPC in accordance with preferred embodiments of the present invention includes terminals each comprising a base portion, a bearing beam and a contact beam substantially parallel extending from the base portion; a housing including an upper wall, a lower wall and a rear wall, and having an inner surface defining a mouth for receiving the FPC and an exterior surface provided with a number of terminal-receiving grooves thereon, each groove comprising an upper groove defined along the upper wall for accommodating the bearing beam, a lower groove defined along the lower wall for accommodating the contact beam, and a rear groove defined on the rear wall for accommodating the base portion; and an actuator pivotally engaging with the bearing beams for establishing electrical connection between the FPC and the contact beams.

Other objects, advantages and novel features of the present invention will become more apparent from the following detailed description of the present embodiment when taken in conjunction with the accompanying drawings.

DETAILED DESCRIPTION OF THE INVENTION

Figure 1:
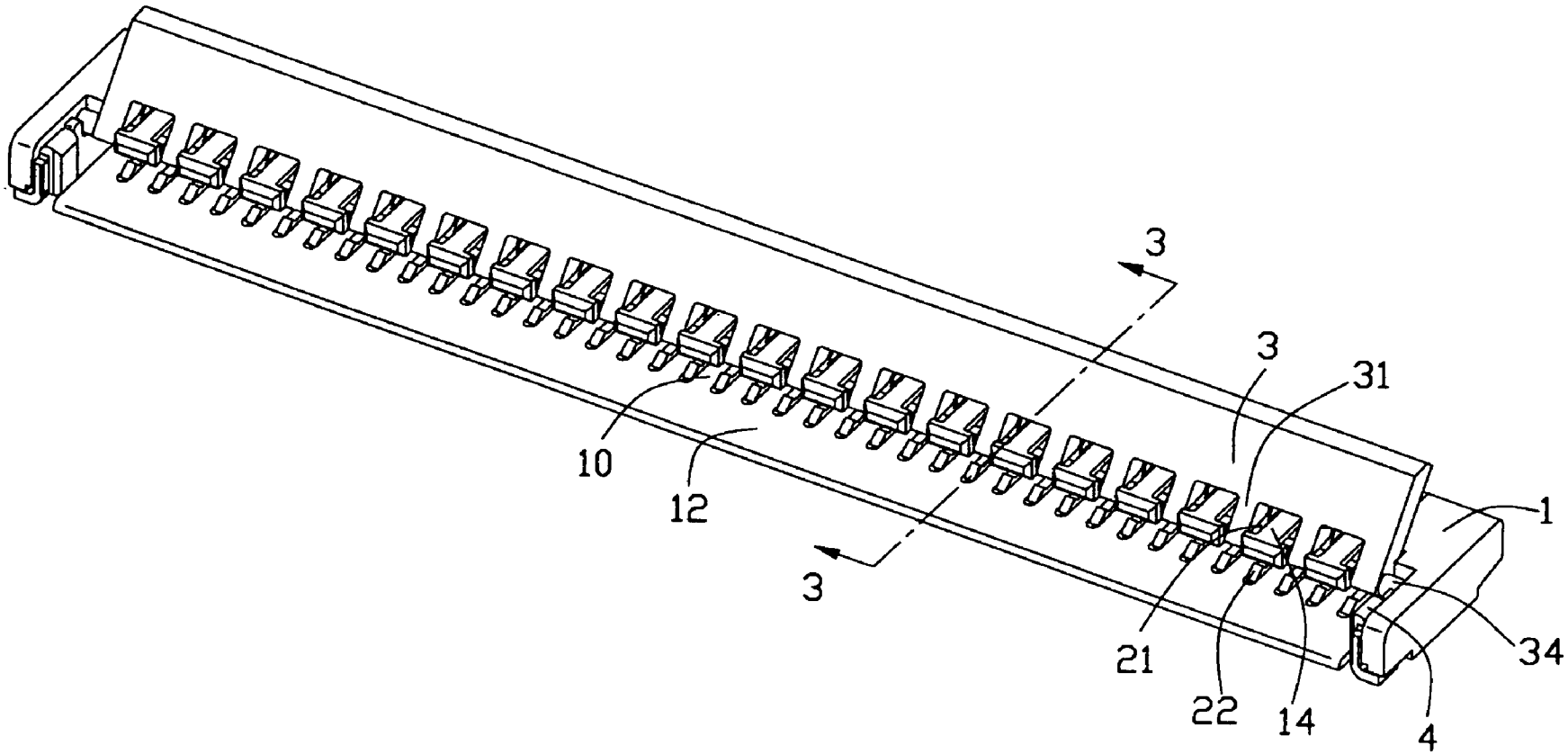
FIG. 1 is an assembled perspective view of an FPC connector in accordance with a first embodiment of the present invention.
Figure 2:
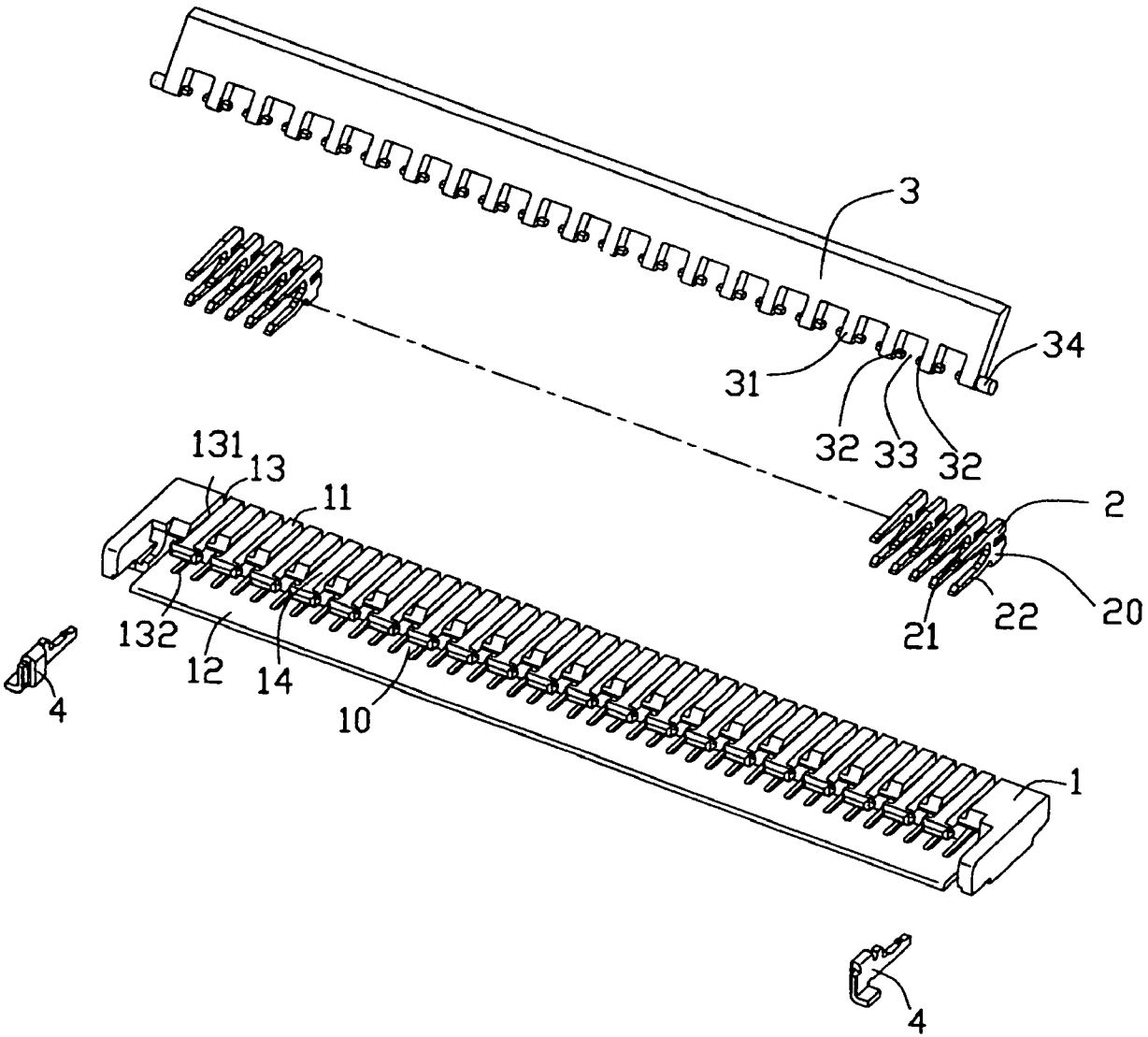
FIG. 2 is an exploded perspective view of the FPC connector shown in FIG. 1.

The present invention will be discussed hereafter in detail in terms of the embodiments of the present invention. However, any well-known structure or feature is not shown in detail in order to avoid unnecessary obscurity of the present invention.

Referring to FIGS. 1–5, description will be made as an FPC connector according to the first embodiment of the present invention. The FPC connector comprises an insulative housing 1, a plurality of terminals 2, an actuator 3, and a pair of support members 4 and is provided with an FPC insertion slot 10 at the front portion thereof. A lower portion of the FPC insertion slot 10 is provided by a bottom wall 12 of the housing 1, and an upper portion of the FPC insertion slot 10 is designed to be opened and closed by the actuator 3.

The housing 1 is provided with a plurality of terminal receiving grooves 13 on an exterior surface thereof, each of which comprises an upper groove 131 defined in an upper wall 11 of the housing 1 and a lower groove 132 defined in a bottom wall 12 of the housing 1, and a rear groove (not labeled) defined in the rear surface of the housing 1 to communicate with both the upper and lower grooves 131, 132, wherein the upper grooves 131 are notched in the top surface of the upper wall 11 which also is the top surface of the FPC connector and give birth to a plurality of spaced spines (not labeled) on the upper wall 11, and the lower grooves 132 are defined through the bottom wall 12 along the thickness direction thereof. The terminals 2 are forwardly inserted into the terminal receiving grooves 13 from a rear side of the housing 1 and are arranged in the housing 1 in side-by-side relationship with a predetermined pitch.

Figure 3A:
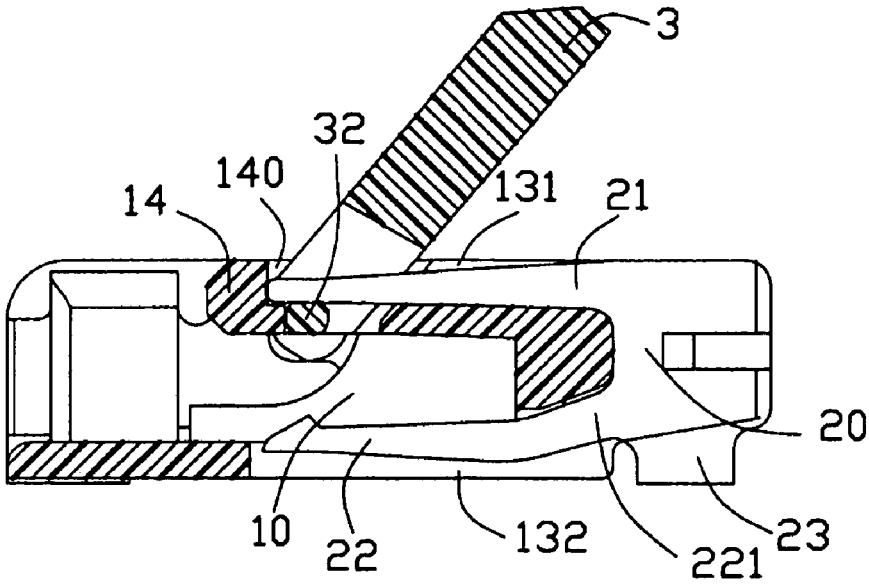
FIG. 3A is a cross-sectional view of FIG. 1 taken along line 3—3, wherein an actuator is placed at an open position.
Figure 3B:
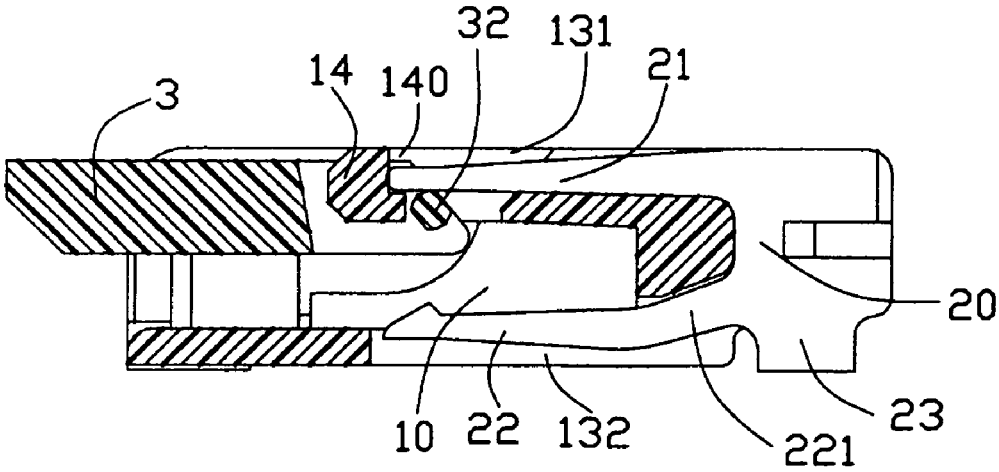
FIG. 3B is a cross-sectional view similar to FIG. 3A, but wherein the actuator has been rotated to a closed position.
Figure 4:
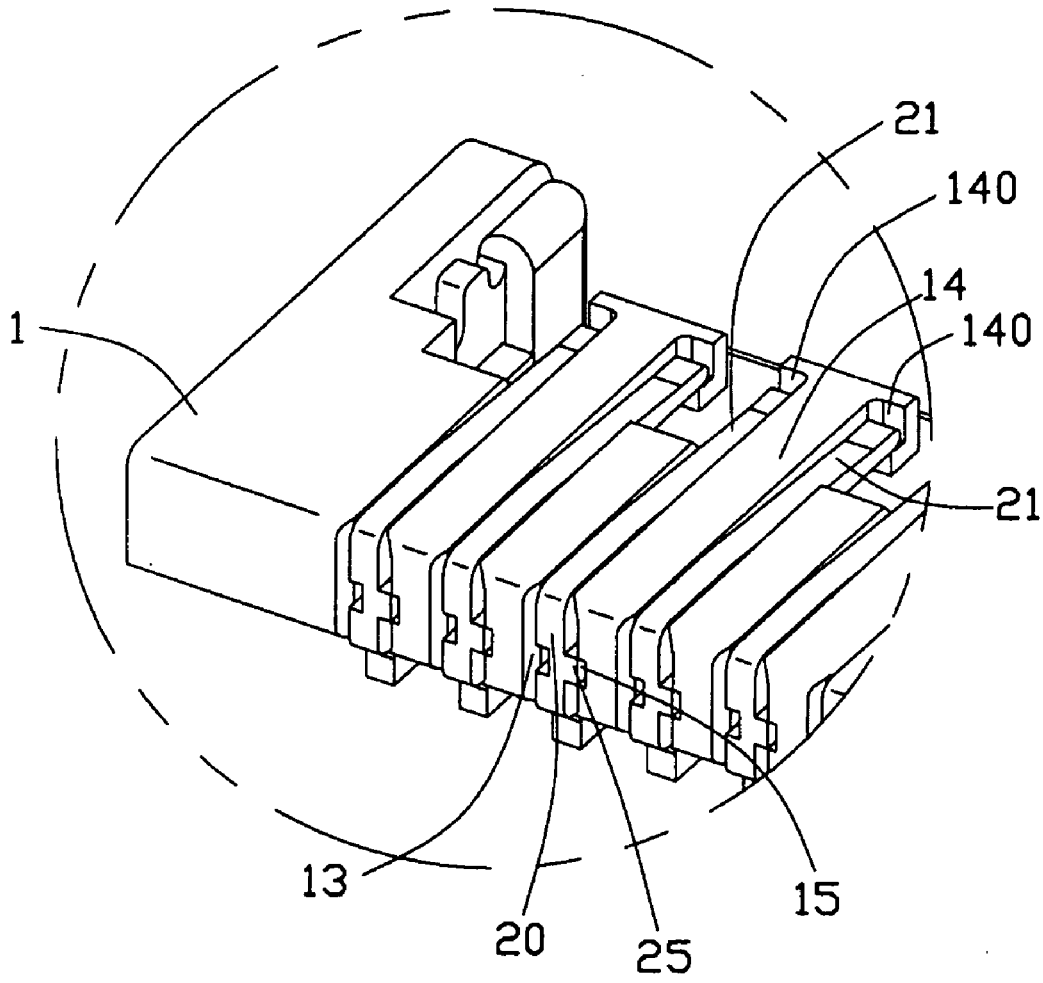
FIG. 4 is a partly magnified view of the FPC connector shown in FIG. 1, specially showing installation of terminals in a housing, and a rotation-preventing design between the terminals and the housing.
Figure 5:
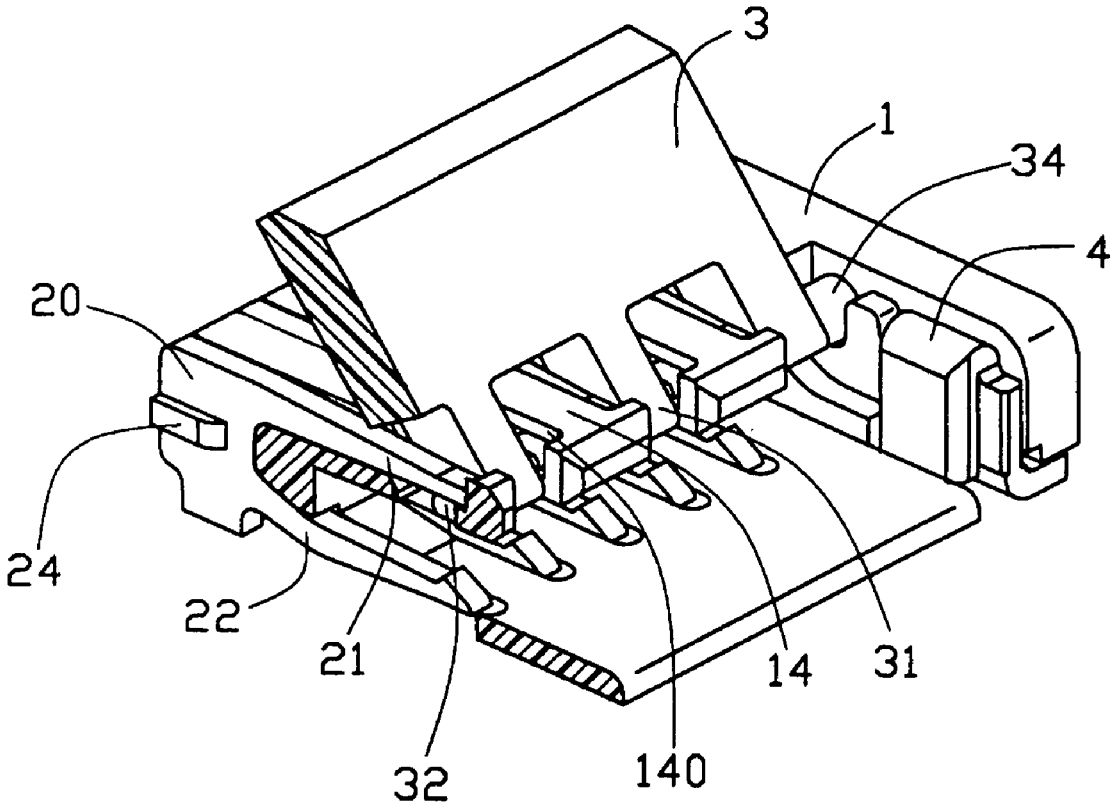
FIG. 5 is a partly cut out perspective view of the FPC connector shown in FIG. 1.

As best shown in FIG. 3, each terminal 2 has a base portion 20, a bearing beam 21 and a contact beam 22 substantially parallel extending from the base portion 20 in cantilever fashion, and a solder foot 23 extending down from the base portion for being soldered to a board, wherein the contact beam 22 is slightly curved up at its root end 221 connecting to the base portion 20 to assure a distance about 0.15 mm to the solder pad (not shown) on which the solder foot 23 is mounted, thereby reducing solder wicking risk. As best shown in FIGS. 3–5, upon being installed in the housing 1, the bearing beam 21 extends within the upper groove 131 and has the top surface thereof upwardly exposed to exterior and substantially leveled with the top surface of the upper wall 11. The contact beam 22 extends within the lower groove 132 and has the upper surface thereof upwardly exposed to the FPC insertion slot and the bottom surface thereof downwardly exposed to exterior and substantially leveled with the bottom surface of the lower wall 12.

Figure 6:
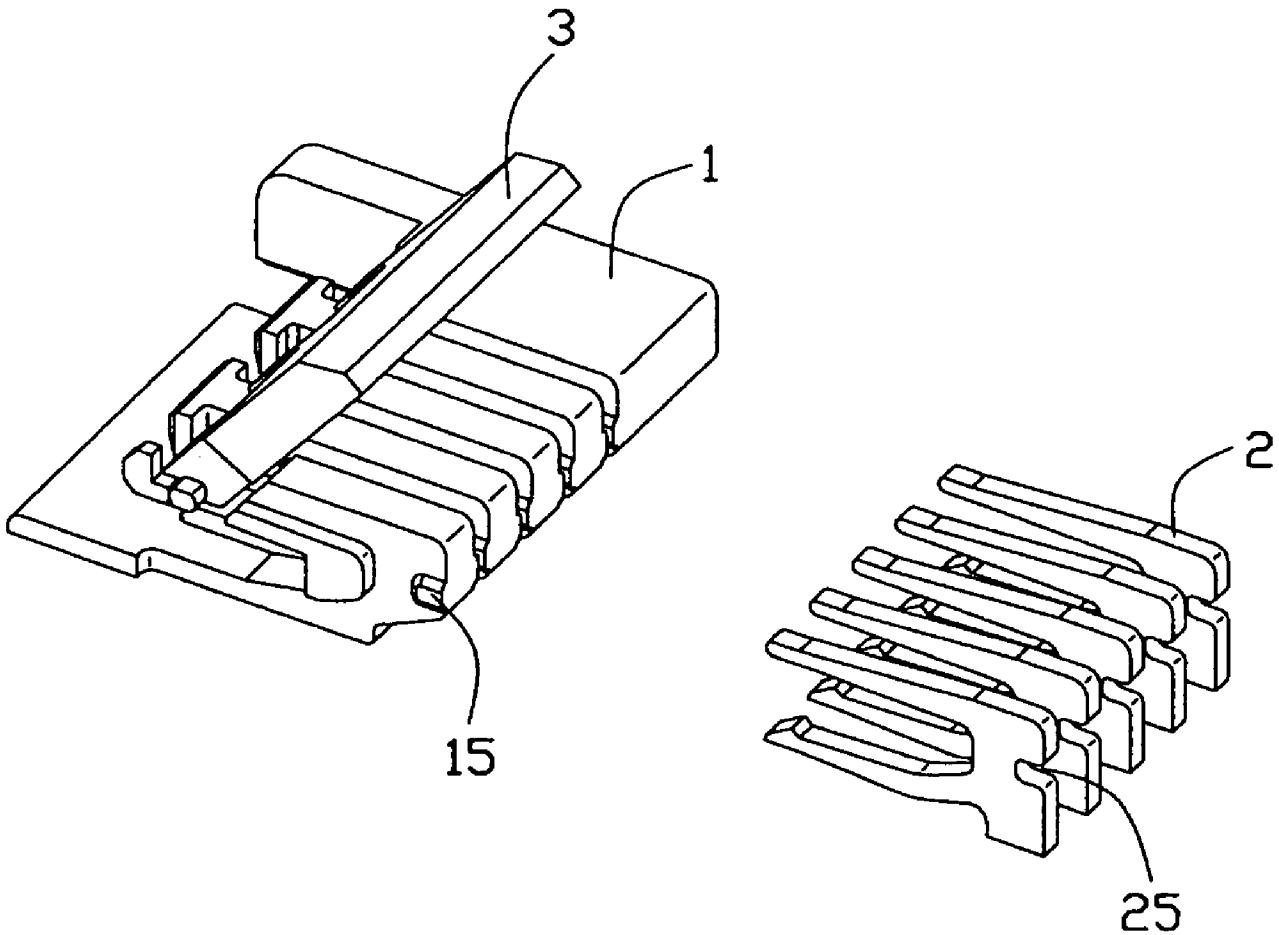
FIG. 6 is a view showing a second kind rotation-preventing design.
Figure 7:
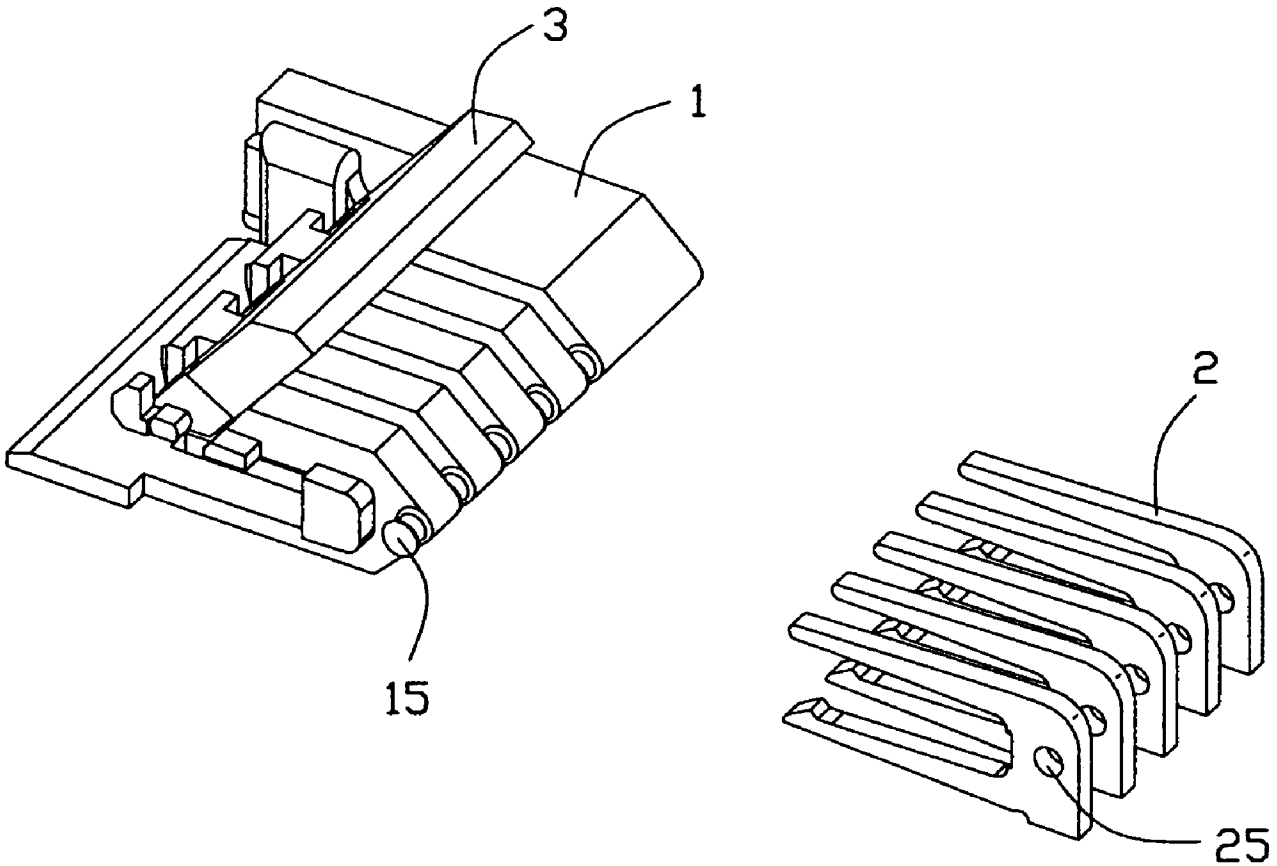
FIG. 7 is a view showing a third kind rotation-preventing design.
Figure 8:
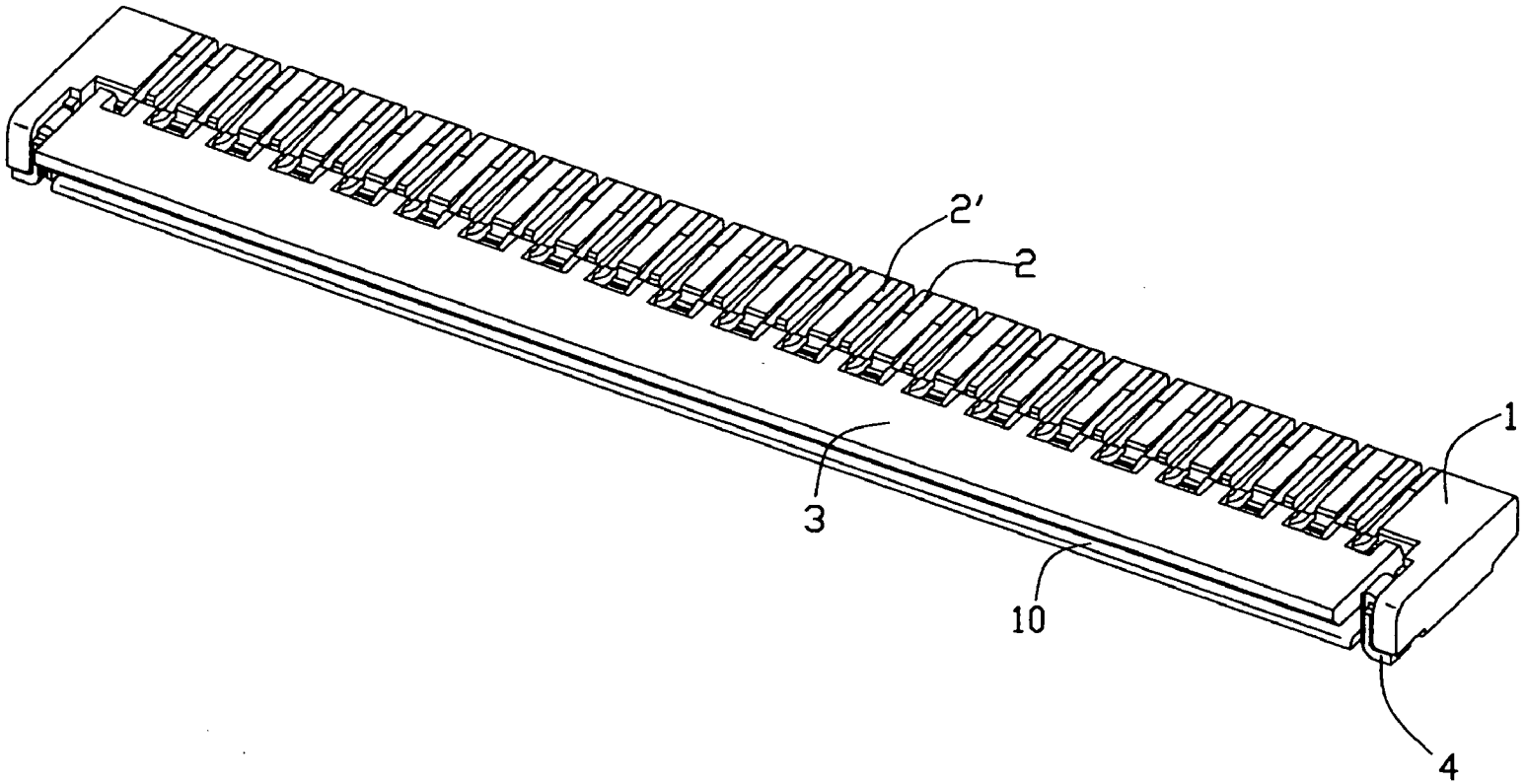
FIG. 8 is an assembled perspective view of an FPC connector in accordance with a second embodiment of the present invention.

With this design, the extra thickness of the upper wall 11 above the bearing beam and the extra thickness of the bottom wall 12 under the contact beam 22 no long exist. So such a structure design minimizes thickness of the upper wall 11 and bottom wall 12 of the housing 1 and thus would reduce the whole height of the FPC connector, thereby forming a lower profile FPC connector. Otherwise, as the bearing beams 21 are upwardly exposed and there is no support above the terminals 2 against upward rotation, the terminals 2 are apt to upwardly rotate during opening or closing operation of the actuator 3. Thus it is required to have a rotation-preventing design between the terminals 2 and the housing 1, which can be embodied by providing a cutout 15 communicating with the terminal receiving groove 13 at the rear portion of the housing 1 and a protuberance 25 sideward protruding from the base portion 20 of the terminal 2 to be fitted in the cutout 15 as shown in FIG. 4, or providing an aperture 25, such as a cutout or a through hole, in the base portion 20 of the terminal 2 and a protuberance 15 protruding from the housing 1 to be fitted in the cut out or through hole 25 as shown in FIGS. 5 and 6, or else like design. Through such a rotation-preventing design, the terminals 2 are firmly fixed in the housing 1 and prevented from upward rotation.

Additionally, the housing 1 is provided with finger portions 14 between every other bearing beams 21. The finger portions 14 integrally extend forwards from the upper wall 11 of the housing 1 and each has a T-shaped enlarged head defining a pair of inwards opened recesses 140 for respectively receiving the tip end of the bearing beam 21 disposed therebeside.

The actuator 3 is formed with a plurality of wedge portions 31 operable as cam portions each interposed between every other bearing beams 21 without the finger portion interposed therebetween. Each of the cam portions 31 is provided with a pair of shaft portion 32 respectively extending from two sides thereof so as to respectively engage with the bearing beams disposed therebeside, wherein the shaft portions 32 extending from different cam portions 31 align with each other along a longitudinal direction of the actuator 3, and the shaft portions 32 extending towards each other respectively from two adjacent cam portions 31 are spaced to define a gap 33 therebetween for lodging the finger portion 14 of the housing 1.

The actuator 3 further has a pair of bosses 34 on both ends thereof to be held on the support member 4 installed in both side portions of the housing 1 for constantly maintaining the engaging condition of the shaft portion 32 and the bearing beam 21. Assembling of the actuator 3 is performed by placing the shaft portions 32 each below a corresponding bearing beam 21 and behind the enlarged head of a corresponding finger portion 14. Then the support members 4 are respectively plugged into the side portions of the housing 1 to support the bosses 34 of the actuator 3 from downward movement, and therefore to maintain engagement between the shaft portion 32 and the bearing beam 21. In assembly, gaps between every two adjacent bearing beams 21 are alternatively interposed with the finger portions 14 of the housing 1 and the cam portions 31 of the actuator 3 and the shaft portions 32 are respectively supported below the corresponding bearing beam 21 from upward movement and supported behind the bottom wall of the recess 140 that receives said corresponding bearing beam 21 from forward movement. Thus the actuator 3 is rotatable between an open position as shown in FIG. 3A where an FPC (not shown) is allowed to be inserted into the FPC insertion slot 10 and a closed position as shown in FIG. 3B where the FPC is urged to electrically contact the contact beams 22 of the terminals 2. During the insertion of the FPC or the rotation of the actuator 3, both the bearing beam 21 and contact beam 22 of the terminal 2 are deflectable freely because there is nothing shielding above the bearing beam 21 or under the contact beam 22, wherein each beam (the bearing beam 21 and the contact beam 22) provides roughly half of the required deflection.

Turning to FIGS. 6–10, description will be made as an FPC connector according to the second embodiment of the present invention. Similar parts are designated by like reference numbers.

The second embodiment discloses an FPC connector with a lower profile structure achieved by a similar manner as to the first embodiment, that is to have the top surface and bottom surface of the terminals exposed to exterior so as to reduce the thickness of the upper wall 11 and the bottom wall 12 of the housing 1. However, in the second embodiment, the engaging manner of the actuator 3 and the terminals is different from the first embodiment. There are two kinds of terminals, first terminals 2 and second terminals 2', alternatively arranged in the housing 1, wherein the first terminal 2 has a pivot shaft 210 integrally bent from the tip end of the bearing beam 21 and the second terminal 2' has no such a pivot shaft. Accordingly, the actuator 3 has a pressing edge (not labeled) formed with a plurality of upward compartments 36 defined by a plurality of partition walls 35. Each partition wall 35 defines a pivot hole 350 for pivotally receiving a corresponding pivot shaft 210.

Figure 9:
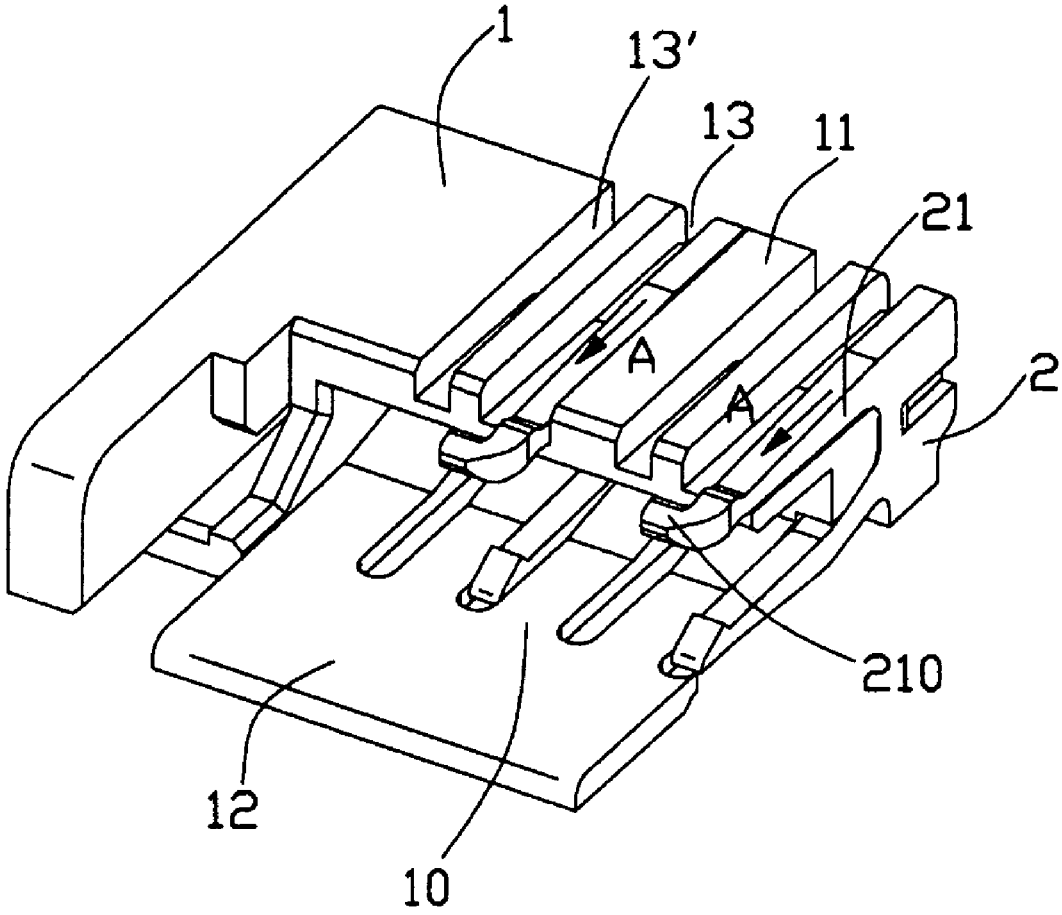
FIG. 9 is a partly cut out perspective view of the FPC connector shown in FIG. 8, showing the assembling of first terminals.
Figure 10:
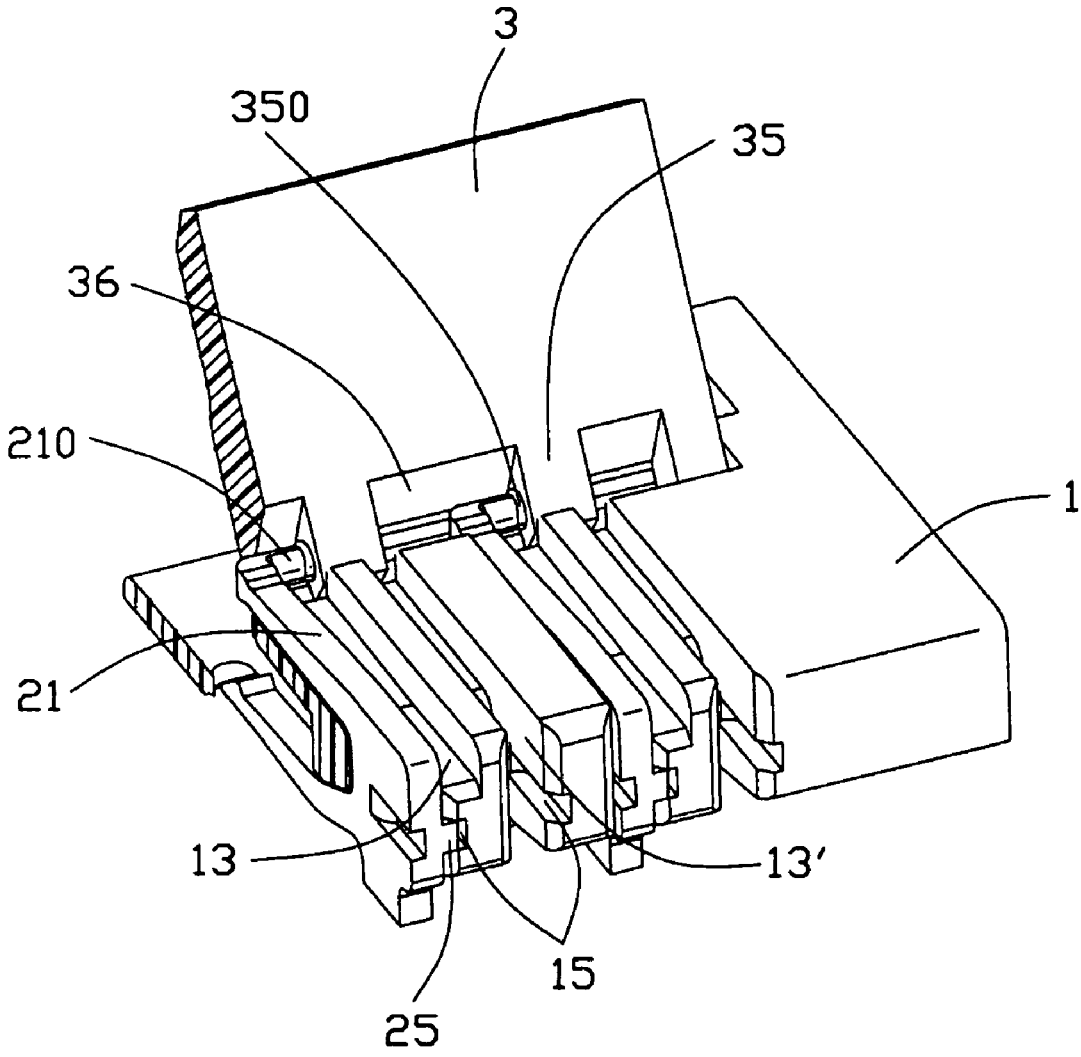
FIG. 10 is a partly cut out perspective view of the FPC connector shown in FIG. 8, showing the assembling of an actuator.
Figure 11:
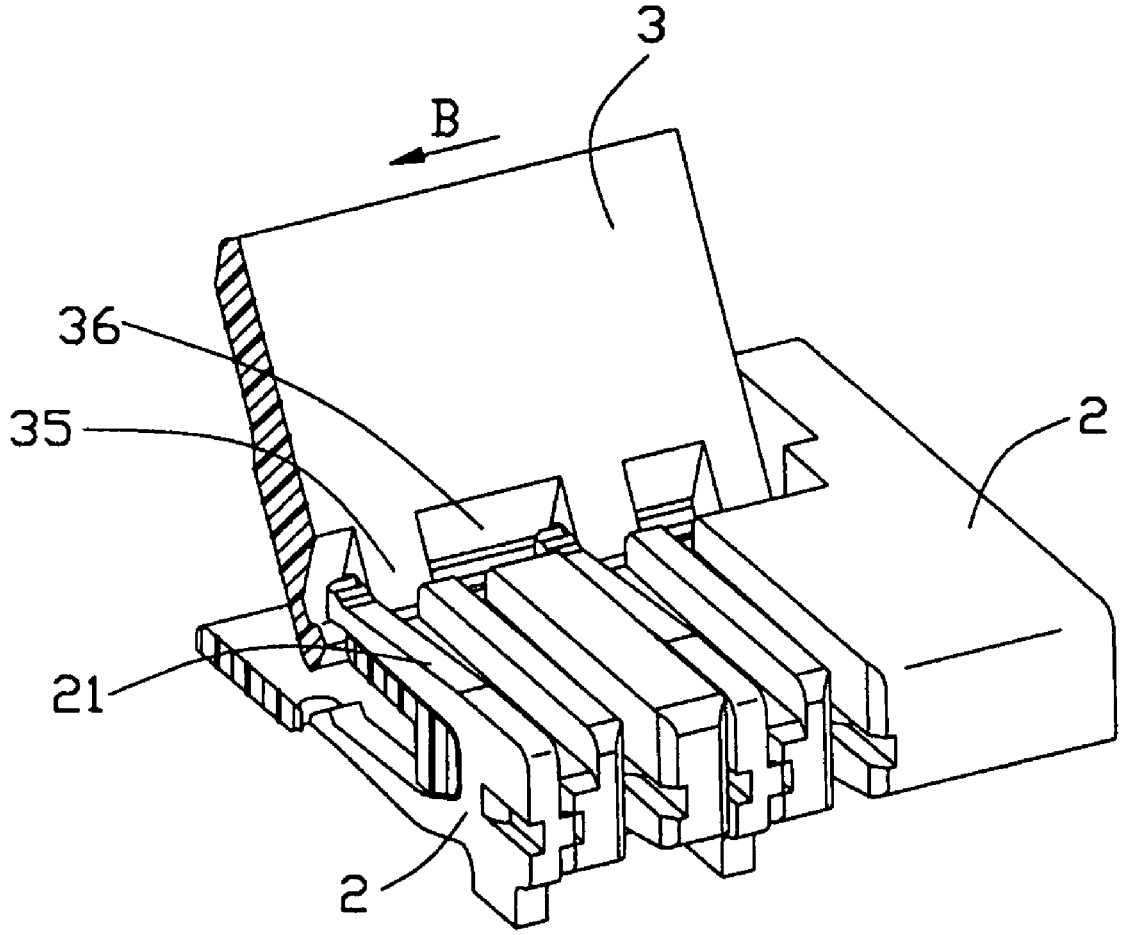
FIG. 11 is a partly cut out perspective view of the FPC connector shown in FIG. 8, showing the further assembling of the actuator.
Figure 12:
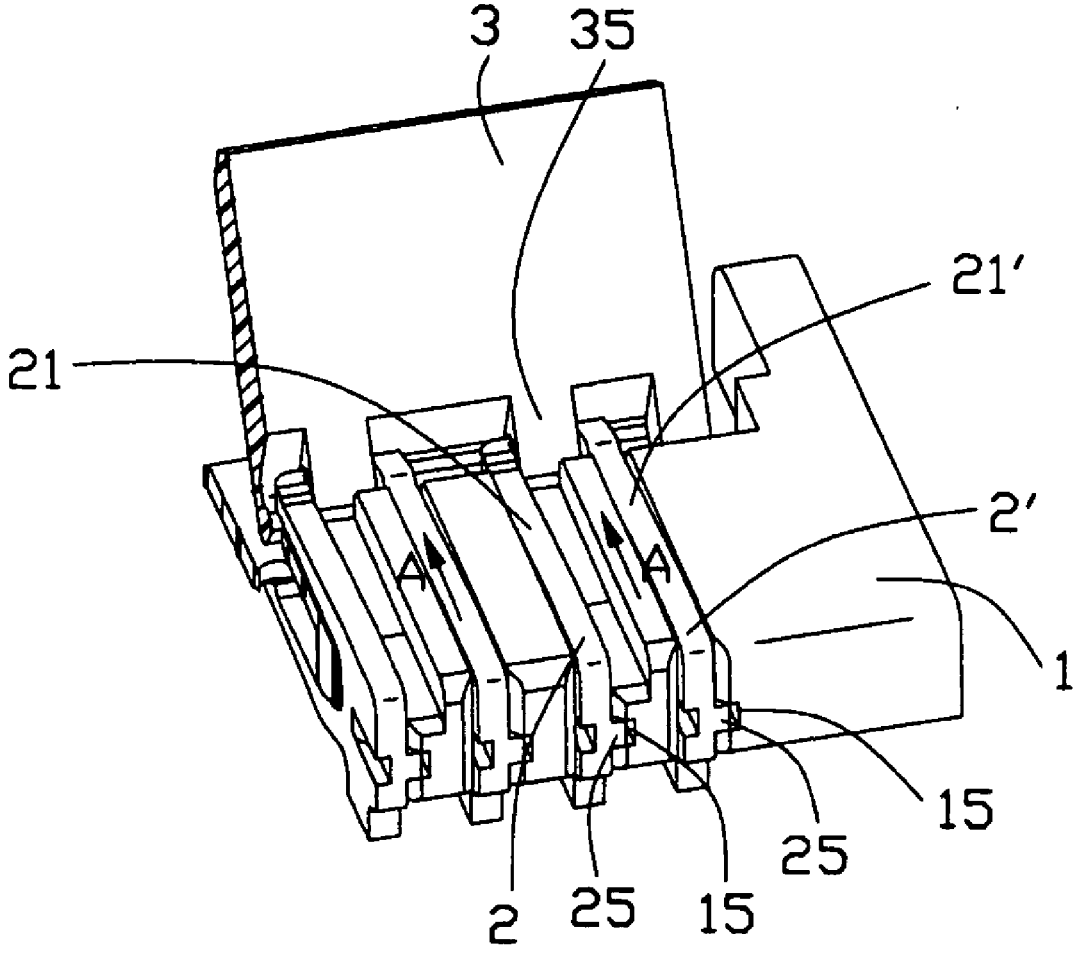
FIG. 12 is a partly cut out perspective view of the FPC connector shown in FIG. 8, showing the assembling of second terminals.

Referring to FIGS. 9–12, assembling of the connector according to this embodiment is detailed hereafter. Firstly, as shown in FIG. 9, the first terminals 2 are inserted into the terminal receiving groove 13 from the rear of the housing 2 along a direction designated as arrow A. Secondly, as shown in FIG. 10, the actuator 3 is positioned to have the pivot shaft 210 of each first terminals 2 be accommodated in a corresponding compartments 36 to align with the corresponding pivot holes 350. Thirdly, as shown in FIG. 11, the actuator 3 is laterally shifted along a longitudinal direction B until the pivot shaft 210 is fully received in the pivot hole 350 and one side of the partition wall 35 abuts against the bearing beam 21. Fourthly, as shown in FIG. 12, the second terminals 2' are forwardly inserted into the terminal receiving groove 13' along the back-to-front direction A to have the bearing beam 21' thereof support against the other side of the partition wall 35. Therefore the first and second terminals 2 and 2' are alternatively arranged in the housing 1, and each partition wall 35 is confined between the bearing beam 21 of the first terminals 2 and the bearing beam 21' of the second terminals 2' which are respectively located in two adjacent compartments 36. Finally, the support members 4 are respectively plugged into the side portions of the housing 1 to support the bosses 34 of the actuator 3 to secure engagement between the actuator 3 and the terminals 2 and 2'.

Thus the actuator 3 is accurately secured in the left and right positions and prevented from shifting in the longitudinal direction, yet is pivotable freely between an open position and a closed position. After inserting the FPC in the connector, the actuator 3 can stably pivot from the open position to the closed position. While at the closed position, an underside of the pressing edge of the actuator 3 urges the FPC to tightly contact with the contact beams 21 (or 21') of the first and second terminals 2, 2'.

There is also a rotation-preventing design between the terminals 2 (or 2') and the housing 1, which can be realized by any one of designs list in the first embodiment, and is actually specialized in this illustrated embodiment by providing a cutout 15 communicating with the terminal receiving groove 13 at the rear portion of the housing 1 and a protuberance 25 sideward protruding from the base portion 20 of the terminal 2 to be fitted in the cutout 15, as shown in FIG. 11.

However, the disclosure is illustrative only, changes may be made in detail, especially in matter of shape, size, and arrangement of parts within the principles of the invention.

What is claimed is:

1. An electrical connector for connecting a sheet-like member, comprising:

an insulative housing defining a mouth for receiving the sheet-like member;

a plurality of terminals forwardly assembled into the housing from a rear face of the housing, each of said terminals defining a base portion from which an upper beam extends forwardly, and a lower beam extending forwardly with a contact section exposed to the mouth; and an actuator rotatably mounted to the housing for pressing the sheet-like member toward the lower beam; wherein said upper beam is essentially fully exposed to an exterior through a top face of the housing, and a protection lip covers the corresponding upper beam in a front-to-back direction and extends from a finger portion located beside the corresponding upper beam in a transverse direction perpendicular to said front-to-back direction.

2. The connector as claimed in claim 1, wherein said lower beam communicates with said exterior via a lower face of the housing.

3. An electrical connector comprising:

an insulative housing defining a mouth for receiving the sheet-like member;

a plurality of terminals forwardly assembled into the housing from a rear face of the housing, each of said terminals defining a base portion from which an upper bearing beam extends forwardly, and a lower contact beam extending forwardly with a contact section exposed to the mouth; and an actuator rotatably mounted to the housing for pressing the sheet-like member toward the contact beam; wherein the upper beam is upwardly deflected relative to the housing when the actuator urges the sheet-like member toward the contact beam, and a protection lip covers the corresponding upper beam in a front-to-back direction and extends from a finger portion located beside the corresponding upper beam in a transverse direction perpendicular to said front-to-back direction.

4. The connector as claimed in claim 3, wherein said bearing beam communicates with an exterior via an upper face of the housing.

5. The connector as claimed in claim 4, wherein said contact beam communicates with the exterior via a lower face of the housing.

6. The connector as claimed in claim 3, wherein the base portion of the terminal comprises a protuberance sideward protruding therefrom and the housing defines a cutout for retaining the protuberance.

7. An electrical connector comprising:

an insulative housing defining a mouth for receiving a sheet-like member;

a plurality of terminals assembled into the housing, each of said terminals defining a base portion, an upper beam extending forwardly from the base portion and essentially fully exposed to an exterior through a top face of the housing, and a lower beam extending forwardly;

an actuator rotatably mounted to the housing for pressing the sheet-like member toward the lower beam; and a protuberance sideward protruding from the base portion and the housing defining a cutout to retain the protuberance for preventing the terminal from upward rotation.

8. The connector as claimed in claim 7, wherein each of the upper beam and the lower bean provides roughly half of a required deflection.

* * * * *